US010697217B2

(12) United States Patent
Sawada

(10) Patent No.: US 10,697,217 B2
(45) Date of Patent: Jun. 30, 2020

(54) HOOD HINGE

(71) Applicant: Toyota Jidosha Kabushiki Kaisha, Toyota-shi, Aichi-ken (JP)

(72) Inventor: Takeshi Sawada, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/802,013

(22) Filed: Nov. 2, 2017

(65) Prior Publication Data

US 2018/0135341 A1 May 17, 2018

(30) Foreign Application Priority Data

Nov. 16, 2016 (JP) ..... 2016-223432

(51) Int. Cl.
*E05D 5/06* (2006.01)
*E05D 5/04* (2006.01)
*E05D 3/02* (2006.01)

(52) U.S. Cl.
CPC ..... *E05D 5/062* (2013.01); *E05D 3/02* (2013.01); *E05D 5/043* (2013.01); *E05D 2005/067* (2013.01); *E05Y 2900/536* (2013.01)

(58) Field of Classification Search
CPC ..... E05D 5/062; E05D 2005/067
See application file for complete search history.

(56) References Cited

U.S. PATENT DOCUMENTS 3,663,987 A * 5/1972 Hawkins ..... E05D 5/06 16/387
4,012,807 A * 3/1977 Kern ..... E05D 3/16 16/288
4,206,944 A * 6/1980 Kumagai ..... E05D 3/18 180/69.21
4,839,941 A * 6/1989 Orlando ..... E05D 3/18 16/346
5,557,827 A * 9/1996 Lautenschlager ..... E05D 5/0276 16/237
6,618,904 B1 * 9/2003 Nagy ..... E05D 3/145 16/288
6,789,834 B2 * 9/2004 Schlegel ..... E05D 3/145 296/136.04

(Continued)

FOREIGN PATENT DOCUMENTS

CN 203318529 U 12/2013
CN 203361818 U 12/2013

(Continued)

*Primary Examiner* — Jeffrey O'Brien
(74) *Attorney, Agent, or Firm* — Dinsmore & Shohl LLP

(57) ABSTRACT

A hood hinge includes a hinge stay and a hinge arm. The hinge stay includes a horizontal plate portion that is fixed to a vehicle body and a vertical plate portion that supports a second end of the hinge arm. The vertical plate portion is erected and extends in a vehicle height direction from a first end of the horizontal plate portion in a vehicle width direction. The hinge arm of the hood hinge is provided with an arm reinforcing bead and the vertical plate portion of the hinge stay is provided with a stay reinforcing bead that extends in the vehicle height direction. The stay reinforcing bead is not provided on a ridge of a connection portion between the vertical plate portion and the horizontal plate portion.

6 Claims, 5 Drawing Sheets

(56) References Cited

U.S. PATENT DOCUMENTS

| | | | | |
|---|---|---|---|---|
| 7,748,767 | B2 * | 7/2010 | Terhaar | B60J 7/1621 16/231 |
| 7,966,695 | B2 * | 6/2011 | Salice | E05D 11/1021 16/286 |
| 8,141,671 | B2 * | 3/2012 | Aoki | B62D 25/12 180/274 |
| 8,251,431 | B2 * | 8/2012 | Nakazato | E05D 5/062 296/146.11 |
| 8,336,666 | B2 * | 12/2012 | Thomas | B60R 21/34 180/274 |
| 8,595,901 | B1 * | 12/2013 | Shaw | E05D 3/02 16/235 |
| 9,145,174 | B2 * | 9/2015 | Iwano | B62D 25/163 |
| 9,352,641 | B2 * | 5/2016 | Chapman | B60R 9/06 |
| 9,752,362 | B2 * | 9/2017 | Nakayama | E05D 5/062 |
| 9,783,154 | B2 * | 10/2017 | Kim | B60R 21/34 |
| 2008/0156556 | A1 * | 7/2008 | Takahashi | B60R 21/38 180/69.21 |
| 2009/0302644 | A1 | 12/2009 | Mori et al. | |
| 2010/0005628 | A1 * | 1/2010 | Jung | B60R 21/34 16/386 |

FOREIGN PATENT DOCUMENTS

| | | | |
|---|---|---|---|
| CN | 205172235 | U | 4/2016 |
| CN | 205477007 | U | 8/2016 |
| JP | 2004182057 | A | 7/2004 |
| JP | 2008239101 | A | 10/2008 |
| JP | 2011131703 | A | 7/2011 |
| JP | 2013169899 | A | 9/2013 |
| JP | 2016060469 | A | 4/2016 |
| JP | 2018058451 | A | 4/2018 |

* cited by examiner

HOOD HINGE

CROSS-REFERENCE TO RELATED APPLICATIONS

This application claims priority to Japanese Patent Application No. 2016-223432 filed on Nov. 16, 2016, which is incorporated herein by reference in its entirety including the specification, drawings and abstract.

BACKGROUND

1. Technical Field

The disclosure relates to a hood hinge for a vehicle.

2. Description of Related Art

A hood hinge for a vehicle includes a hinge stay that is fixed to a vehicle body and a hinge arm of which a first end is fixed to a rear end portion of an engine hood and a second end is rotatably supported by the hinge stay. It is desired that the engine hood of the vehicle or a peripheral portion of the engine hood has a certain level of brittleness so as to absorb shock at the time of collision with a pedestrian.

Japanese Unexamined Patent Application Publication No. 2013-169899 (JP 2013-169899 A) discloses a hood hinge that improves a pedestrian protecting ability and in which an attachment portion between an engine hood and a hinge arm is brittle with a portion of the hinge arm that is fixed to a rear end portion of the engine hood being low in rigidity.

SUMMARY

Meanwhile, it is conceivable to lower the rigidity of a hinge stay 1 to improve a shock absorbing ability for a time when the hinge stay 1 collides with a collision object X approaching from above as illustrated in FIG. 8. However, when the rigidity of the hinge stay 1 supporting a hinge arm 2 is lowered, the hinge stay 1 is likely to be bent in a vehicle width direction in a case where the hinge stay 1 receives a force via an engine hood 3 and the hinge arm 2 at the time of collision with an object approaching from a position in front of a vehicle although the shock absorbing ability can be improved. When the hinge stay is bent in the vehicle width direction, the engine hood 3 moves such that the engine hood 3 is shifted in the vehicle width direction as illustrated in FIG. 9 and there is a possibility that a rear end portion of the engine hood 3 may be damaged due to collision with a front windshield 4, a cowl top panel that is positioned below a front end of the front windshield 4, or the like as illustrated with a broken line.

Note that, the cowl top panel or the front windshield 4 may also be damaged due to collision with the rear end portion of the engine hood 3 when the hinge arm extending in a vehicle front-rear direction is bent in the vehicle width direction. In addition, particularly, in a case of a so-called oblique collision in which the vehicle collides with a collision object Y approaching from a position obliquely in front of the vehicle as illustrated in FIG. 9, the hinge stay and the hinge arm are likely to be bent in the vehicle width direction.

A first aspect relates to a hood hinge which supports an engine hood of a vehicle such that the engine hood is opened and closed with a rear end of the engine hood as a fulcrum. The hood hinge includes a hinge stay and a hinge arm. The hinge stay is fixed to a vehicle body. A first end of the hinge arm is fixed to a rear end portion of the engine hood and a second end of the hinge arm is rotatably supported by the hinge stay, the hinge arm extending in a vehicle front-rear direction. The hinge stay includes a horizontal plate portion that is fixed to the vehicle body and a vertical plate portion that supports the second end of the hinge arm. The vertical plate portion is erected in a vehicle height direction from a first end of the horizontal plate portion in a vehicle width direction, and the vertical plate portion extends in the vehicle front-rear direction. The hinge arm is provided with an arm reinforcing bead that extends in a direction in which the hinge arm extends. The vertical plate portion of the hinge stay is provided with a stay reinforcing bead that extends in the vehicle height direction and the stay reinforcing bead is not provided on a ridge of a connection portion between the vertical plate portion and the horizontal plate portion.

According to the aspect, the rigidity of the hinge arm is increased with the arm reinforcing bead and the rigidity of the vertical plate portion of the hinge stay is increased with the stay reinforcing bead. Therefore, it is possible to restrain the vertical plate portion of the hinge stay or the hinge arm from being bent in the vehicle width direction at a time of collision with an object approaching from a position in front of the vehicle. Furthermore, the hinge arm is rotatably supported by the hinge stay. Therefore, in a case where the hinge arm and the hinge stay are less likely to be deformed with the rigidities of the hinge arm and the hinge stay being increased, the hinge arm is likely to rotate in such a direction that the engine hood is opened when the hinge arm receives a force that is transmitted via the engine hood due to collision. When the hinge arm rotates in this manner, the rear end portion of the engine hood is lifted up and the rear end portion of the engine hood is less likely to collide with a cowl top panel or a front windshield in comparison with a case where the hinge arm or the hinge stay is bent in the vehicle width direction.

In addition, according to the aspect, the vertical plate portion is provided with the stay reinforcing bead but the stay reinforcing bead is not provided on a ridge of the connection portion between the vertical plate portion and the horizontal plate portion. Therefore, the stay reinforcing bead does not contribute to an improvement in rigidity of the connection portion between the vertical plate portion and the horizontal plate portion. Accordingly, at a time of collision with a collision object approaching from a position above the hinge stay, the hinge stay is bent along the ridge of the connection portion that extends in the vehicle front-rear direction and the hinge stay is deformed such that the vertical plate portion tilts in the vehicle width direction.

That is, according to the aspect, it is possible to suppress damage to the cowl top panel or the front windshield and to secure a pedestrian protecting ability at the same time by increasing the rigidities of the hinge arm and the hinge stay without improving the rigidity of the connection portion between the vertical plate portion and the horizontal plate portion.

In the hood hinge according to the aspect, the vertical plate portion may have, as the stay reinforcing bead, a line of bead extending in the vehicle height direction, and the line of bead may be positioned between a first portion of the vertical plate portion that supports the second end of the hinge arm and a second portion of the vertical plate portion that is connected to the horizontal plate portion.

In some embodiments, in view of restraining the engine hood from moving such that the engine hood is shifted in the vehicle width direction at a time of collision, the vertical plate portion is reinforced such that deformation in which a portion of the vertical plate portion supporting the second end of the hinge arm moves in the vehicle width direction is suppressed. In this regard, according to the aspect, it is possible to suppress such deformation with a simple configuration in which a line of bead is provided.

In the hood hinge according to the aspect, the vertical plate portion may include a main body portion that has a quadrangular shape in a side view as seen from a vehicle lateral side and is connected to the horizontal plate portion and a supporting portion that protrudes upwards from a portion of the main body portion corresponding to an upper side of the quadrangular shape and supports the second end of the hinge arm, and the stay reinforcing bead may extend over the supporting portion and the main body portion.

According to the aspect of, the shape of the vertical plate portion in a side view changes relatively greatly at a connection portion between the supporting portion and the main body portion. Accordingly, a stress resulting from a force that is input via the hinge arm at a time of collision is likely to be concentrated on the connection portion. According to the aspect, the bead is provided to straddle the connection portion between the supporting portion and the main body portion. Therefore, the vicinity of the portion on which the stress is likely to be concentrated is effectively reinforced and it is possible to suppress the deformation of the vertical plate portion.

In the hood hinge according to the aspect, the hinge arm may have a line of bead, as the arm reinforcing bead, and the line of bead may be positioned between the first end of the hinge arm that is fixed to the rear end portion of the engine hood and the second end of the hinge arm that is supported by the hinge stay.

In some embodiments, in view of restraining the engine hood from moving such that the engine hood is shifted in the vehicle width direction at a time of collision, the hinge arm is reinforced such that deformation in which the first end and the second end of the hinge arm relatively move in the vehicle width direction is suppressed. In this regard, according to the aspect, it is possible to suppress such deformation with a simple configuration in which a line of bead is provided.

In the hood hinge according to the aspect, the hinge arm may include a curved portion that is curved downwards at a position between the first end and the second end and the arm reinforcing bead may be is provided over the entire length of the curved portion in a direction in which the curved portion extends.

In the case of the hinge arm including the curved portion, when a force acts in a direction such that the first end and the second end move toward each other at a time of collision, buckling in which the curved portion is further bent is likely to occur. In this regard, according to the aspect, the curved portion is provided with the arm reinforcing bead. Therefore, it is possible to increase the rigidity of the curved portion that is likely to buckle and to effectively suppress the deformation of the hinge arm.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
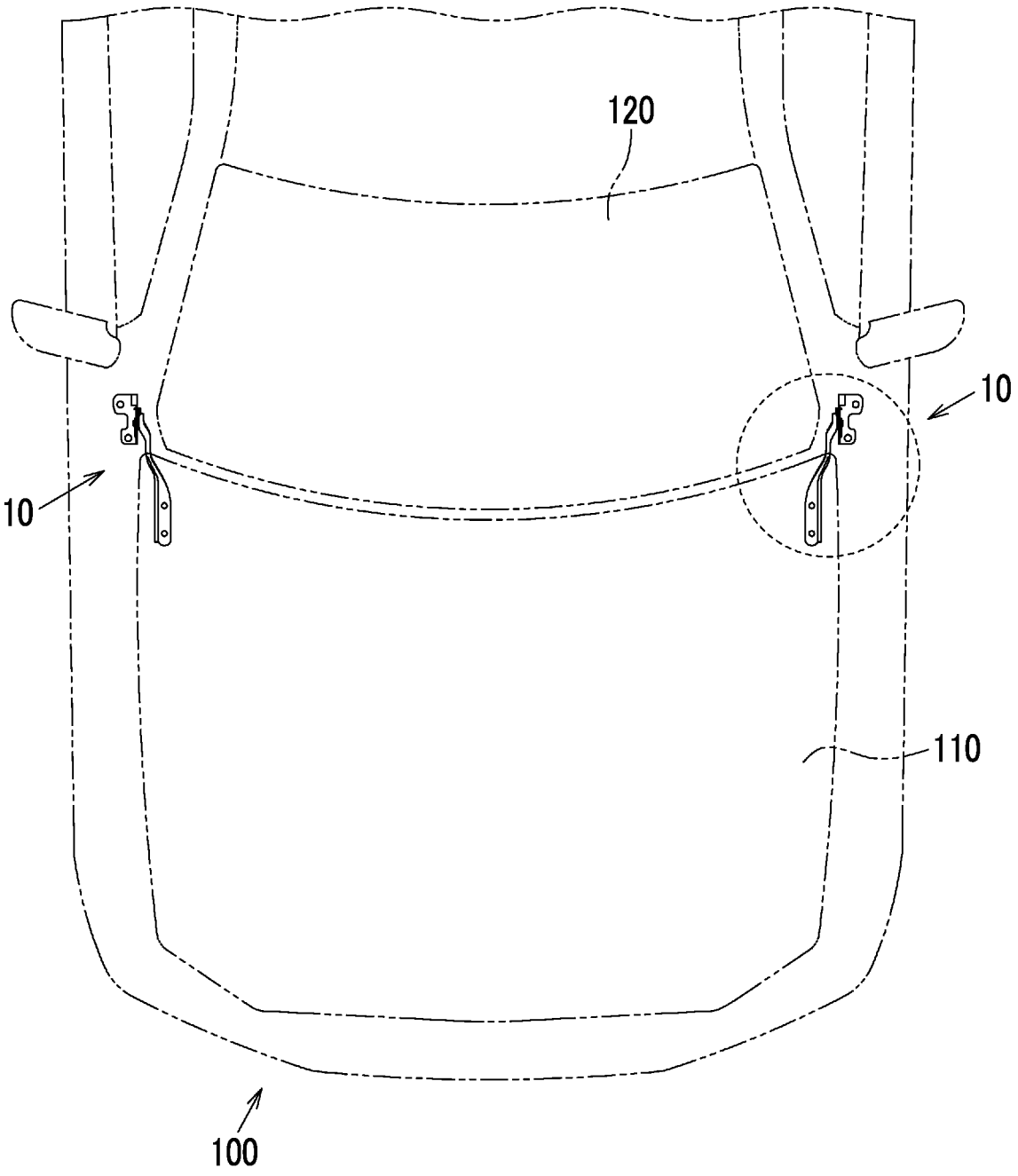
FIG. 1 is a top view of a front side of a vehicle that illustrates how a hood hinge according to an embodiment is disposed.

Hereinafter, an embodiment of a hood hinge will be described with reference to FIGS. 1 to 7. As illustrated in FIG. 1, an engine hood 110 is disposed to be closer to vehicle front side than a front windshield 120 of a vehicle 100. Hood hinges 10 are used to attach the engine hood 110 to a vehicle body such that the engine hood 110 can be opened and closed with a rear end of the engine hood 110 as a fulcrum and the hood hinges 10 are disposed in the vicinity of a front end of the front windshield 120. The hood hinges 10 fix opposite rear end portions of the engine hood 110 in a vehicle width direction to the vehicle body and a pair of right and left hood hinges 10 is disposed with the hood hinges 10 being separated from each other in the vehicle width direction.

The right and left hood hinges 10 have right-left symmetrical shapes and have the same configuration except that the right and left hood hinges 10 are right-left symmetrically formed. Therefore, in the following description, the hood hinge 10 that is surrounded by a broken line in FIG. 1 and is disposed on the left side of the vehicle will be described and detailed description of the hood hinge 10 disposed on the right side of the vehicle will be omitted.

Figure 2:
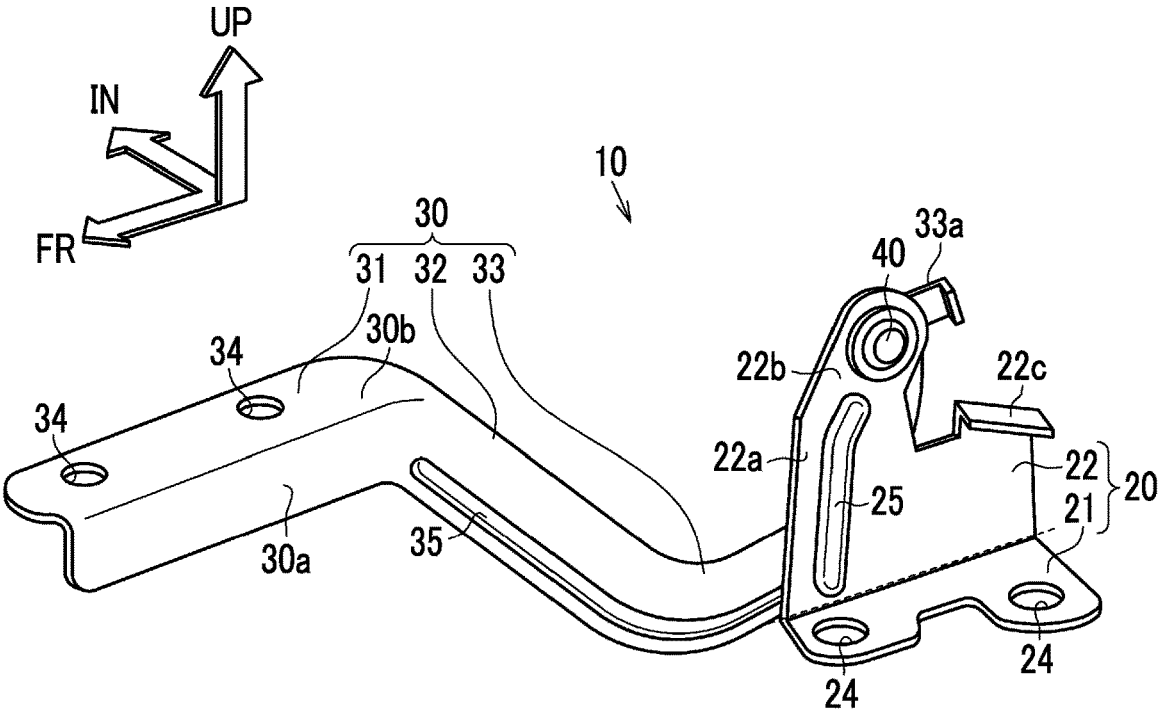
FIG. 2 is a perspective view of the hood hinge according to the embodiment.

As illustrated in FIG. 2, the hood hinge 10 is obtained by connecting a hinge arm 30 and a hinge stay 20 to each other with a fixation pin 40 that is a rotation shaft. In FIG. 2, a direction toward the vehicle front side is illustrated with an arrow FR, an upward direction is illustrated with an arrow UP, and a direction toward the inner side in the vehicle width direction is illustrated with an arrow IN.

The hinge stay 20 is a component formed by bending a metal plate material through press working and the hinge stay 20 includes a horizontal plate portion 21 that extends in both of the vehicle width direction and a vehicle front-rear direction and a vertical plate portion 22 that is erected and extends in both of a vehicle height direction and the vehicle front-rear direction from an inner end portion of the horizontal plate portion 21 in the vehicle width direction.

Figure 3:
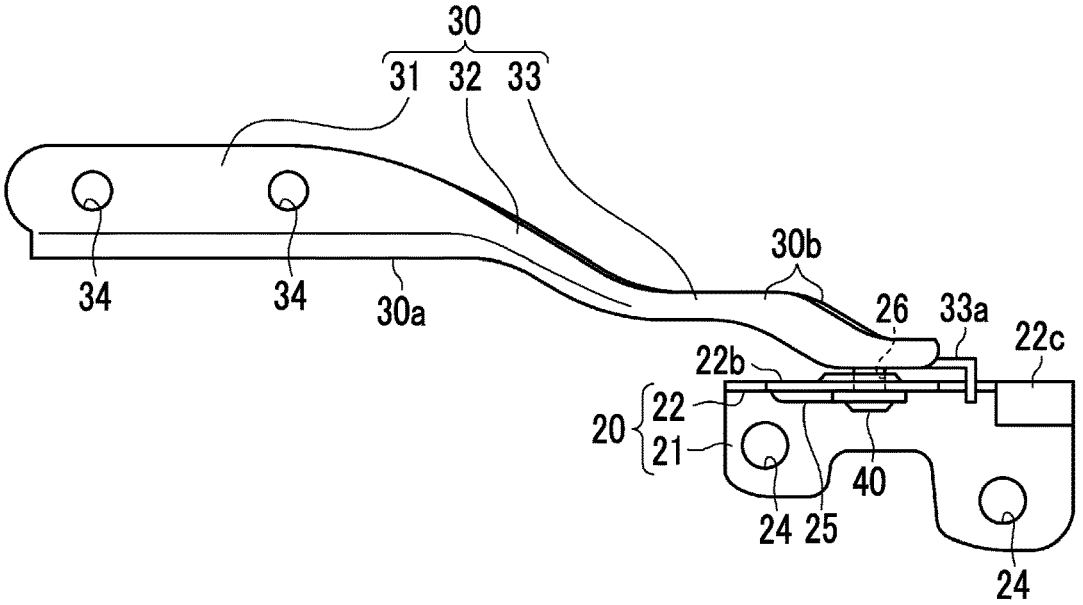
FIG. 3 is a top view of the hood hinge according to the embodiment.

As illustrated in FIG. 3, the horizontal plate portion 21 is provided with two bolt holes 24 that are formed to be separated from each other in the vehicle front-rear direction. In addition, a portion of the horizontal plate portion 21 that is positioned between the two bolt holes 24 is relatively small in dimension in the vehicle width direction.

Figure 4:
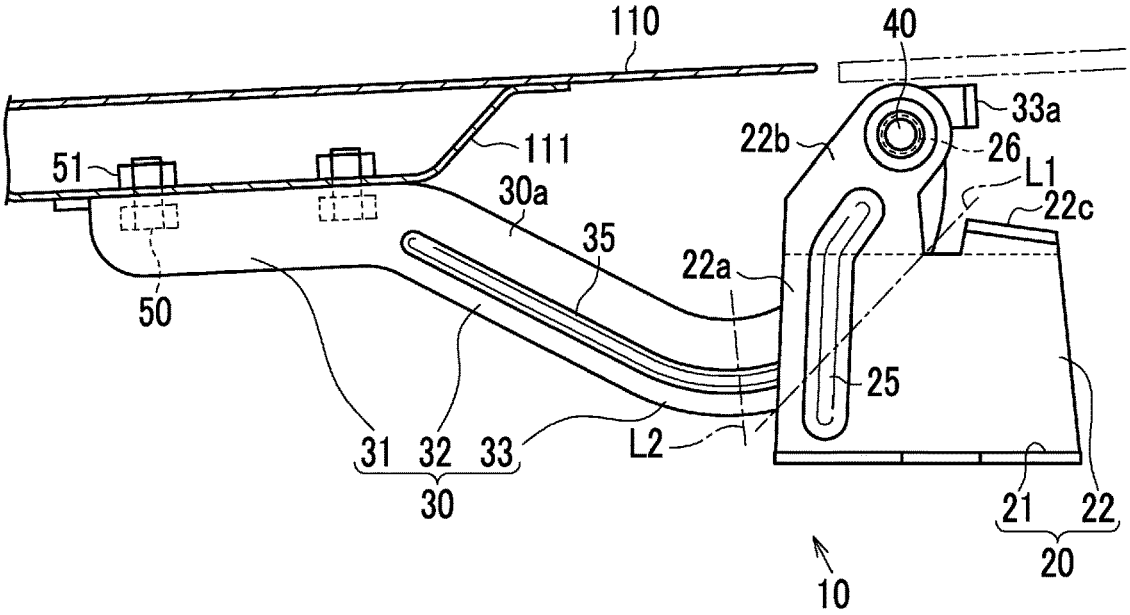
FIG. 4 is a side view of the hood hinge according to the embodiment.

As illustrated in FIG. 4, the vertical plate portion 22 includes a main body portion 22*a* (that is below a broken line in FIG. 4), a supporting portion 22*b*, and a protrusion portion 22*c*. The main body portion 22*a* has a quadrangular shape in a side view as seen from a vehicle lateral side and is connected to the horizontal plate portion 21. The supporting portion 22*b* and the protrusion portion 22*c* protrude upwards from a portion of the main body portion 22*a* that corresponds to an upper side of the quadrangular shape (a portion of the main body portion 22*a* illustrated with the broken line in FIG. 4).

The supporting portion 22*b* and the protrusion portion 22*c* are separated from each other in the vehicle front-rear direction and the supporting portion 22*b* is positioned on a portion of the vertical plate portion 22 that is on the vehicle front side and the protrusion portion 22*c* is positioned on a portion of the vertical plate portion 22 that is on the vehicle rear side.

As illustrated in FIG. 2, an upper end portion of the protrusion portion 22*c* has a shape that is curved outwards in the vehicle width direction. As illustrated in FIG. 4, the supporting portion 22*b* extends up to a position above the protrusion portion 22*c*. In addition, a through-hole 26 is formed in the supporting portion 22*b*.

As illustrated in FIG. 3, a shaft portion of the fixation pin 40 that is a rotation shaft of the hinge arm 30 is inserted into the through-hole 26 such that the hinge arm 30 and the fixation pin 40 are fixed with the supporting portion 22*b* interposed between a head portion of the fixation pin 40 of which the diameter is larger than that of the shaft portion and the hinge arm 30. Since the diameter of the through-hole 26 is slightly larger than the diameter of the shaft portion of the fixation pin 40 that is inserted into the through-hole 26, the hinge arm 30 is rotatably supported by the supporting portion 22*b* when the fixation pin 40 and the hinge arm 30 are fixed in the above-described manner.

In addition, as illustrated in FIGS. 2 and 4, a stay reinforcing bead 25 extending in the vehicle height direction is formed on the vertical plate portion 22 of the hinge stay 20. The stay reinforcing bead 25 is formed on a portion of the vertical plate portion 22 that is positioned between a portion of the vertical plate portion 22 to which the fixation pin 40 is attached, that is, a portion of the vertical plate portion 22 that supports the rotation shaft of the hinge arm 30 and a portion of the vertical plate portion 22 that is connected to the horizontal plate portion 21. The stay reinforcing bead 25 is represented by a line of a projected portion.

The stay reinforcing bead 25 is formed by causing a portion of the vertical plate portion 22 to protrude outwards in the vehicle width direction. The stay reinforcing bead 25 extends upwards from a position above the portion of the vertical plate portion 22 that is connected to the horizontal plate portion 21 and is formed over the main body portion 22*a* and the supporting portion 22*b*. Although the stay reinforcing bead 25 extends in the vehicle height direction as a whole, the stay reinforcing bead 25 is curved at a boundary between the main body portion 22*a* and the supporting portion 22*b* and a portion of the stay reinforcing bead 25 that is formed on the supporting portion 22*b* is inclined toward the vehicle rear side while extending toward a portion to which the fixation pin 40 is attached.

The hinge arm 30 is a component formed by bending a metal plate material through press working as with the hinge stay 20. As illustrated in FIGS. 2 to 4, the hinge arm 30 extends in the vehicle front-rear direction as a whole with an intermediate portion of the hinge arm 30 being curved and a vehicle front side end portion of the hinge arm 30 is a fixation portion 31 that is fixed to a rear end portion of the engine hood 110. Meanwhile, a vehicle rear side end portion of the hinge arm 30 is rotatably supported by the hinge stay 20 via the fixation pin 40 as described above.

As illustrated in FIGS. 2 and 4, the hinge arm 30 includes a curved portion 33 that is curved downwards and a straight portion 32 that linearly extends. The curved portion 33 and the straight portion 32 are disposed between the vehicle rear side end portion of the hinge arm 30 that is rotatably supported by the hinge stay 20 via the fixation pin 40 and the fixation portion 31. In addition, the curved portion 33, the straight portion 32, and the fixation portion 31 are arranged in this order in a direction from the vehicle rear side end portion of the hinge arm 30 toward the vehicle front side.

In addition, as illustrated in FIG. 3, the hinge arm 30 is configured to include a side wall 30*a* that extends in the vehicle height direction and a flange 30*b* that extends inwards in the vehicle width direction from a peripheral edge of the side wall 30*a*.

Both of an upper edge portion and a lower edge portion of each of the curved portion 33 and the straight portion 32 of the hinge arm 30 are provided with the flange 30*b* and an upper edge portion of the fixation portion 31 is provided with the flange 30*b*. The dimension of the flange 30*b* of the fixation portion 31 is larger than the dimension of the flange 30*b* of other portions in the vehicle width direction. Bolt holes 34 for fixation of the engine hood 110 are formed in the flange 30*b* having a large dimension in the vehicle width direction. The bolt holes 34 are provided to be separated from each other in the vehicle front-rear direction and the number of the bolt holes 34 is two.

In addition, as illustrated in FIGS. 2 to 4, a portion of the vehicle rear side end portion of the hinge arm 30 is a stopper portion 33*a* that protrudes to the vehicle rear side. As illustrated in FIG. 3, a tip end of the stopper portion 33*a* is curved outwards in the vehicle width direction. When the hinge arm 30 rotates around the fixation pin 40, the tip end of the stopper portion 33*a* abuts onto the vertical plate portion 22 of the hinge stay 20, more specifically, the supporting portion 22*b*. Therefore, the rotation of the hinge arm 30 over the supporting portion 22*b* is regulated and a fully open position of the engine hood 110 is determined.

As illustrated in FIGS. 2 and 4, an arm reinforcing bead 35 that extends in a direction in which the hinge arm 30 extends is formed on the side wall 30*a* of the hinge arm 30. The arm reinforcing bead 35 is formed on the side wall 30*a* of a portion of the hinge arm 30 that is positioned between the vehicle rear side end portion of the hinge arm 30 to which the fixation pin 40 is fixed and the fixation portion 31. That is, the arm reinforcing bead 35 is formed on the side wall 30*a* of each of the curved portion 33 and the straight portion 32. The arm reinforcing bead 35 is represented by a line of a projected portion.

The arm reinforcing bead 35 is formed by causing a portion of the side wall 30*a* to protrude inwards in the vehicle width direction. The arm reinforcing bead 35 is provided over the entire length of the curved portion 33 such that the arm reinforcing bead 35 extends from the vicinity of a portion to which the fixation pin 40 is fixed towards the vehicle front side and extends over the straight portion 32. In addition, the arm reinforcing bead 35 extends up to a position before the fixation portion 31.

As illustrated in FIG. 4, a rear end portion of the engine hood 110 is fastened to the fixation portion 31 of the hinge arm 30 with bolts 50 and nuts 51. Specifically, the nuts 51 are fixed to an inner panel 111 of the engine hood 110 and the bolts 50 are inserted into the bolt holes 34 in a state where the fixation portion 31 of the hinge arm 30 abuts onto the inner panel 111 such that the bolts 50 are fastened to the nuts 51. In this manner, the rear end portion of the engine hood 110 is fixed to the fixation portion 31 of the hinge arm 30.

Figure 5:
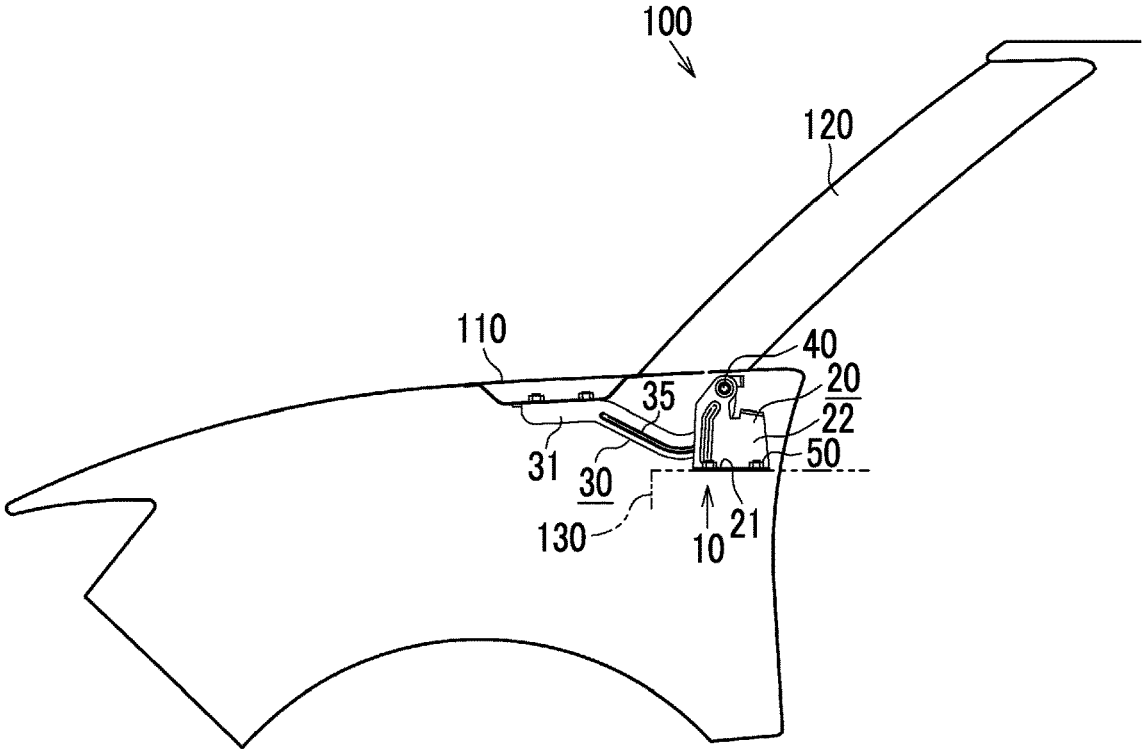
FIG. 5 is a schematic view illustrating the hood hinge attached to a vehicle body.

In addition, as illustrated in FIG. 5, the hinge stay 20 of the hood hinge 10 is fixed to the vehicle body with the bolts 50. Specifically, the bolts 50 are inserted into the bolt holes 24 formed on the horizontal plate portion 21 after placing the horizontal plate portion 21 of the hinge stay 20 on a bracket 130 on the vehicle body side such that the horizontal plate portion 21 is fastened to the bracket 130 with the bolts 50.

In this manner, the hood hinge 10 fixes the engine hood 110 of the vehicle 100 to the vehicle body such that the engine hood 110 can be opened and closed with the rear end of the engine hood 110 as a fulcrum as illustrated in FIGS. 1 and 5. Next, an operation and an effect of the hood hinge 10 in the embodiment will be described.

As illustrated in FIG. 1, the front windshield 120 of the vehicle 100 is curved such that the closer the front windshield 120 is to the central position in the vehicle width direction, the closer the front windshield 120 is to the vehicle front side. The rear end portion of the engine hood 110 has a curved shape that matches the shape of a front end of the front windshield 120.

Figure 9:
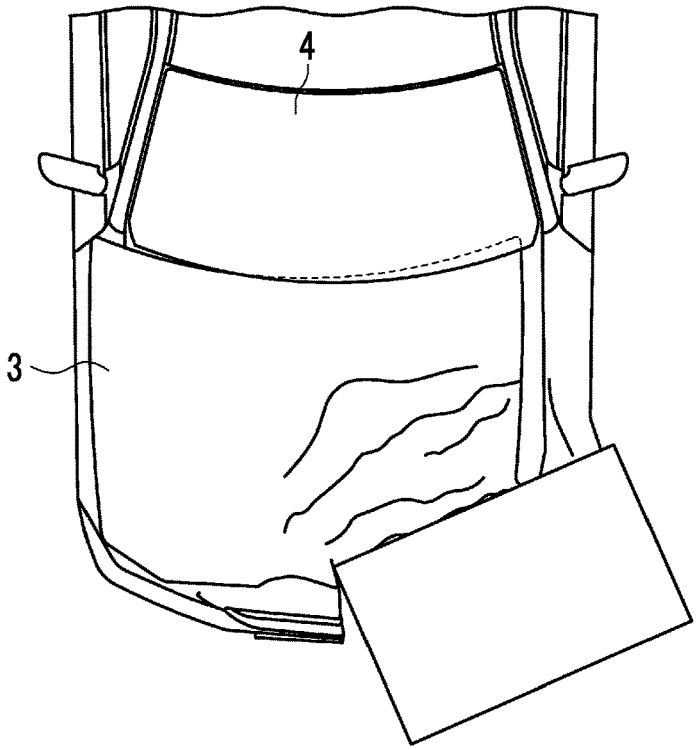
FIG. 9 RELATED ART
FIG. 9 is a top view of a front side of a vehicle that illustrates the state of an engine hood at a time of collision.

As illustrated in FIG. 9, when a hinge stay or a hinge arm is bent in the vehicle width direction at a time of collision with a collision object Y approaching from a position in front of a vehicle, an engine hood moves such that the engine hood is shifted in the vehicle width direction. A rear end portion of the engine hood has a curved shape as described above. Therefore, when the engine hood moves such that the engine hood is shifted in the vehicle width direction, there is a possibility that an outer portion of the rear end portion in the vehicle width direction may collide with a front windshield, a cowl top panel that is positioned below a front end of the front windshield, or the like as illustrated with a broken line in FIG. 9. In addition, there is a possibility that the front windshield, the cowl top panel, or the like is damaged.

However, the rigidity of the hinge arm 30 of the hood hinge 10 is increased with the arm reinforcing bead 35 and the rigidity of the vertical plate portion 22 of the hinge stay 20 is increased with the stay reinforcing bead 25. Therefore, it is possible to restrain the vertical plate portion 22 of the hinge stay 20 or the hinge arm 30 from being bent in the vehicle width direction at a time of collision with the collision object Y approaching from a position in front of the vehicle.

Figure 6:
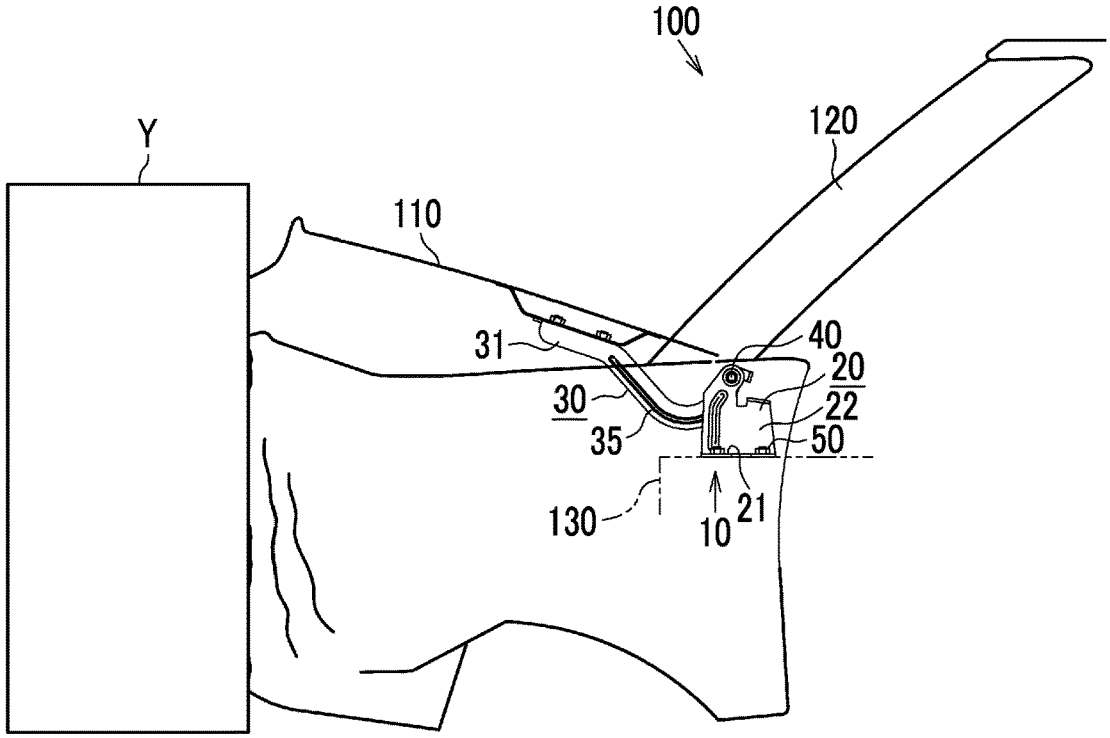
FIG. 6 is a schematic view illustrating the hood hinge at the time of collision with an object approaching from a position in front of the vehicle.

The hinge arm 30 is rotatably supported. Therefore, in a case where the hinge arm 30 and the hinge stay 20 are less likely to be deformed with the rigidities of the hinge arm 30 and the hinge stay 20 being increased, as illustrated in FIG. 6, the hinge arm 30 is likely to rotate in such a direction that the engine hood 110 is opened when the hinge arm 30 receives a force that is transmitted via the engine hood 110 at a time of collision with the collision object Y.

Figure 7:
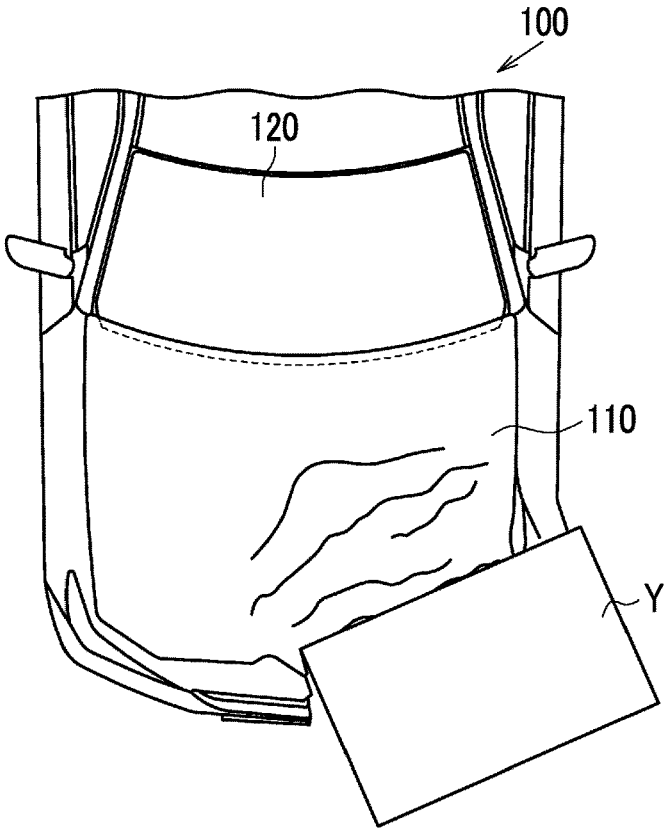
FIG. 7 is a top view of the front side of the vehicle that illustrates the state of an engine hood at a time of collision of the vehicle to which the hood hinge is applied.
Figure 8:
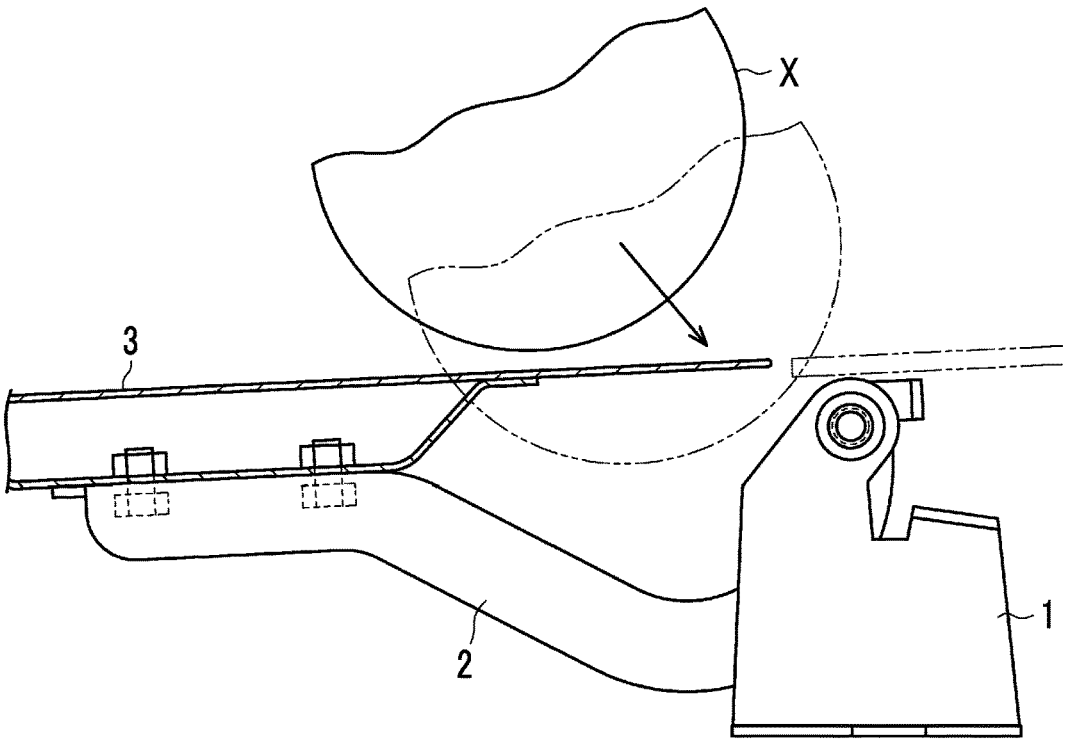
FIG. 8 RELATED ART
FIG. 8 is a side view of a hood hinge that illustrates a state where a hinge stay collides with a collision object approaching from above.

As illustrated in FIG. 7, when the hinge arm 30 rotates due to the collision with the collision object Y, the rear end portion of the engine hood 110 is lifted up and the rear end portion of the engine hood 110 moves to a position at which the rear end portion overlaps the front windshield 120 in the vertical direction without colliding with the front end of the front windshield 120 that is illustrated with a broken line.

Therefore, the rear end portion of the engine hood 110 is less likely to collide with a cowl top panel or the front windshield 120 in comparison with a case where the hinge arm 30 or the hinge stay 20 is bent in the vehicle width direction (FIG. 9).

In addition, in a case where the rear end portion of the engine hood 110 is lifted such that the rear end portion moves to a position at which the rear end portion overlaps the front windshield 120 while being positioned above the front windshield 120, the engine hood 110 is likely to move such that the engine hood 110 slides on the front windshield 120 even when the rear end portion of the engine hood 110 collides with the front windshield 120. Therefore, the front windshield 120 is less likely to be damaged in comparison with a case where the engine hood 110 moves such that the engine hood 110 is shifted in the vehicle width direction and the rear end portion of the engine hood 110 collides with the front windshield 120 such that the rear end portion of the engine hood 110 cuts the front windshield 120 in the vehicle width direction.

In addition, as illustrated in FIG. 2, although the stay reinforcing bead 25 is provided on the vertical plate portion 22 of the hood hinge 10, the stay reinforcing bead 25 does not reach the horizontal plate portion 21. That is, the stay reinforcing bead 25 is not provided on a ridge of a connection portion between the vertical plate portion 22 and the horizontal plate portion 21. Therefore, the stay reinforcing bead 25 does not contribute to an improvement in rigidity of the connection portion between the vertical plate portion 22 and the horizontal plate portion 21. Accordingly, at a time of collision with a collision object approaching from a position above the hinge stay 20, the hinge stay 20 is bent along the ridge (a broken line in FIG. 2) of the connection portion that extends in the vehicle front-rear direction and the hinge stay 20 is deformed such that the vertical plate portion 22 tilts inwards or outwards in the vehicle width direction.

That is, with the hood hinge 10, it is possible to suppress damage to the cowl top panel or the front windshield 120 and to secure a pedestrian protecting ability at the same time by increasing the rigidities of the hinge arm 30 and the hinge stay 20 without improving the rigidity of the connection portion between the vertical plate portion 22 and the horizontal plate portion 21.

In addition, the following effects can be achieved according to the embodiment. (1) In some embodiments, in view of restraining the engine hood 110 from moving such that the engine hood 110 is shifted in the vehicle width direction at a time of collision, the vertical plate portion 22 is reinforced such that deformation in which the supporting portion **22*b* supporting the rotation shaft of the hinge arm 30 moves in the vehicle width direction is suppressed. With a configuration in which the stay reinforcing bead 25 extending in the vehicle height direction is provided on a portion of the vertical plate portion 22 that is positioned between a portion of the vertical plate portion 22 that is connected to the horizontal plate portion 21 and the supporting portion 22*b* as with the hood hinge 10, it is possible to suppress such deformation with a simple configuration in which a line of bead (the stay reinforcing bead 25**) is provided.

(2) As illustrated in FIG. 4, the shape of the vertical plate portion 22 in a side view changes relatively greatly at a connection portion between the supporting portion **22*b* and the main body portion 22*a*. Accordingly, a stress resulting from a force that is input via the hinge arm 30 at a time of collision is likely to be concentrated on the connection portion. Therefore, the vertical plate portion 22 may be bent such that the supporting portion 22*b* tilts inwards or outwards in the vehicle width direction with the connection portion as a fulcrum due to a force that is input from the vehicle front side via the hinge arm 30 at a time of collision. For example, the vertical plate portion 22 may be bent at a portion illustrated with a one-dot chain line L1. In this case, the engine hood 110 moves such that the engine hood 110 is shifted in the vehicle width direction. However, in the hood hinge 10, the stay reinforcing bead 25 is provided to straddle the connection portion between the supporting portion 22***b* and the main body portion 22*a*. Therefore, the vicinity of the portion on which the stress is likely to be concentrated is effectively reinforced and it is possible to suppress the deformation of the vertical plate portion.

(3) In some embodiments, in view of restraining the engine hood 110 from moving such that the engine hood 110 is shifted in the vehicle width direction at a time of collision, the hinge arm 30 is reinforced such that deformation in which the first end and the second end of the hinge arm 30 relatively move in the vehicle width direction is suppressed. With a configuration in which the arm reinforcing bead 35 is provided on a portion of the hinge arm 30 that is positioned between the vehicle rear side end portion of the hinge arm 30 that is supported by the hinge stay 20 and the fixation portion 31 as with the hood hinge 10, it is possible to suppress such deformation with a simple configuration in which a line of bead (the arm reinforcing bead 35) is provided.

(4) As illustrated in FIG. 4, the hinge arm 30 includes the curved portion 33 that is curved downwards. In the case of the hinge arm 30 including the curved portion 33, when a force acts in a direction such that the first end and the second end move toward each other at a time of collision, buckling in which the curved portion 33 is further bent is likely to occur. Particularly, in a case where a force is applied from a position obliquely in front of the vehicle as in a case of an oblique collision and a force in the vehicle width direction is also applied to the hinge arm 30, the curved portion 33 may be bent in the vehicle width direction due to such buckling. For example, the curved portion 33 may be bent inwards or outwards in the vehicle width direction at a portion illustrated with a one-dot chain line L2. In this case, the engine hood 110 moves such that the engine hood 110 is shifted in the vehicle width direction. However, in the hood hinge 10, the curved portion 33 is provided with the arm reinforcing bead 35. Therefore, it is possible to increase the rigidity of the curved portion 33 that is likely to buckle and to effectively suppress the deformation of the hinge arm 30.

The embodiment can be appropriately modified as follows. A plurality of stay reinforcing beads extending in the vehicle height direction may be provided on the vertical plate portion 22. For example, the stay reinforcing beads extending in the vehicle height direction may be provided on the vertical plate portion 22 such that the stay reinforcing beads are arranged in the vehicle front-rear direction. In addition, a bead extending in the vehicle front-rear direction may be provided on the vertical plate portion 22 in addition to a stay reinforcing bead extending in the vehicle height direction in order to reinforce the vertical plate portion 22. In this case, the stay reinforcing bead extending in the vehicle height direction and the bead extending in the vehicle front-rear direction may intersect each other.

The specific shape of the stay reinforcing bead may be appropriately modified as long as the stay reinforcing bead does not reach the horizontal plate portion 21 and does not contribute to the rigidity of the connection portion between the vertical plate portion 22 and the horizontal plate portion 21. For example, the stay reinforcing bead may linearly extend in the vehicle height direction without the intermediate portion of the stay reinforcing bead being curved. In addition, the entire stay reinforcing bead may be inclined toward the vehicle rear side while linearly extending toward a portion at which the fixation pin 40 is supported. In addition, the stay reinforcing bead may not be provided between the connection portion between the vertical plate portion 22 and the horizontal plate portion 21 and a portion at which the fixation pin 40 is supported and the stay reinforcing bead can be provided on any portion of the vertical plate portion 22 as long as the stay reinforcing bead does not reach the horizontal plate portion 21.

The stay reinforcing bead may not be provided over the supporting portion 22*b* and the main body portion 22*a*. The hinge arm 30 may be provided with a plurality of arm reinforcing beads. The arm reinforcing beads may be provided to be arranged in the vehicle height direction. In addition, for example, the arm reinforcing beads may be provided to be arranged in an area between the vicinity of the fixation pin 40 and the fixation portion 31 in a direction in which the hinge arm 30 extends as if the arm reinforcing bead 35 is divided into a plurality of portions.

The arm reinforcing bead may not be provided with the curved portion. The hinge arm 30 may not be curved. The hinge arm 30 may not be configured to include the side wall 30*a* and the flange 30*b*. For example, the flange 30*b* may not be provided as long as the engine hood 110 can be fixed.

Although a method of fixing the hinge arm 30 with the fixation pin 40 has been described above, a method of fixing the hinge arm 30 may be appropriately modified as long as the hinge arm 30 is rotatably supported by the hinge stay 20.

The hinge stay 20 of the hood hinge 10 may not be fixed to the vehicle body with the bolts 50 and the engine hood 110 may not be fixed to the hinge arm 30 with the bolts 50. For example, the fixation may be achieved through welding or bonding.

What is claimed is:

1. A hood hinge which supports an engine hood of a vehicle such that the engine hood is opened and closed with a rear end of the engine hood as a fulcrum, the hood hinge comprising:

a hinge stay fixed to a vehicle body; and a hinge arm having a first end fixed to a rear end portion of the engine hood and a second end rotatably supported by the hinge stay via a fixation pin, the hinge arm extending in a vehicle front-rear direction, wherein:

the hinge stay includes a horizontal plate portion that is fixed to the vehicle body and a vertical plate portion that supports the second end of the hinge arm;

the vertical plate portion is erected in a vehicle height direction from a first end of the horizontal plate portion in a vehicle width direction, and the vertical plate portion extends in the vehicle front-rear direction;

the hinge stay includes a connection portion that extends in the vehicle front-rear direction between the vertical plate portion and the horizontal plate portion, the hinge stay configured to deform at the connection portion at a time of collision such that the vertical plate portion tilts in the vehicle width direction;

the hinge arm includes a curved portion and a straight portion provided in order between the second and first ends of the hinge arm, the curved portion curving downwardly at a position between the first end and the second end, and the straight portion extending linearly;

the hinge arm is provided with an arm reinforcing bead that extends over an entire length of the curved and straight portions, from a vicinity of a portion of the hinge arm to which the fixation pin is fixed and in a direction in which the hinge arm extends;

the vertical plate portion of the hinge stay is provided with a stay reinforcing bead that extends in the vehicle height direction and the stay reinforcing bead is not provided on a ridge of the connection portion between the vertical plate portion and the horizontal plate portion;

the arm reinforcing bead extends outwardly from a side face of the hinge arm between and spaced apart from an upper edge of the hinge arm and a lower edge of the hinge arm; and the arm reinforcing bead and the stay reinforcing bead overlap when the hood is in a closed position.

2. The hood hinge according to claim 1, wherein the vertical plate portion has, as the stay reinforcing bead, a line of bead extending in the vehicle height direction, and the line of bead is positioned between a first portion of the vertical plate portion that supports the second end of the hinge arm and a second portion of the vertical plate portion that is connected to the horizontal plate portion.

3. The hood hinge according to claim 2, wherein:

the vertical plate portion includes a main body portion that has a quadrangular shape in a side view as seen from a vehicle lateral side and is connected to the horizontal plate portion and a supporting portion that protrudes upwards from a portion of the main body portion corresponding to an upper side of the quadrangular shape and supports the second end of the hinge arm; and the stay reinforcing bead extends over the supporting portion and the main body portion.

4. The hood hinge according to claim 1, wherein the hinge arm has a line of bead, as the arm reinforcing bead.

5. A hood hinge which supports an engine hood of a vehicle such that the engine hood is opened and closed with a rear end of the engine hood as a fulcrum, the hood hinge comprising:

a hinge stay fixed to a vehicle body; and a hinge arm having a first end fixed to a rear end portion of the engine hood and a second end rotatably supported by the hinge stay, the hinge arm extending in a vehicle front-rear direction, wherein:

the hinge stay includes a horizontal plate portion that is fixed to the vehicle body and a vertical plate portion that supports the second end of the hinge arm;

the vertical plate portion is erected in a vehicle height direction from a first end of the horizontal plate portion in a vehicle width direction, and the vertical plate portion extends in the vehicle front-rear direction;

the hinge arm is provided with an arm reinforcing bead that extends in a direction in which the hinge arm extends;

the vertical plate portion of the hinge stay is provided with a stay reinforcing bead that extends in the vehicle height direction and the stay reinforcing bead is not provided on a ridge of a connection portion between the vertical plate portion and the horizontal plate portion;

the stay reinforcing bead is curved at above a middle point of the stay reinforcing bead in the vehicle height direction such that an upper end of the stay reinforcing bead is located rearward of the vehicle than a lower end of the stay reinforcing bead;

the arm reinforcing bead extends outwardly from a side face of the hinge arm between and spaced apart from an upper edge of the hinge arm and a lower edge of the hinge arm;

the arm reinforcing bead and the stay reinforcing bead overlap when the hood is in a closed position; and the connection portion extends in the vehicle front-rear direction between the vertical plate portion and the horizontal plate portion, the hinge stay configured to deform at the connection portion at a time of collision such that the vertical plate portion tilts in the vehicle width direction.

6. A hood hinge which supports an engine hood of a vehicle such that the engine hood is opened and closed with a rear end of the engine hood as a fulcrum, the hood hinge comprising:

a hinge stay fixed to a vehicle body; and a hinge arm having a first end fixed to a rear end portion of the engine hood and a second end rotatably supported by the hinge stay, the hinge arm extending in a vehicle front-rear direction, wherein:

the hinge stay includes a horizontal plate portion that is fixed to the vehicle body and a vertical plate portion that supports the second end of the hinge arm;

the vertical plate portion is erected in a vehicle height direction from a first end of the horizontal plate portion in a vehicle width direction, and the vertical plate portion extends in the vehicle front-rear direction;

the hinge arm is provided with an arm reinforcing bead that extends in a direction in which the hinge arm extends;

the vertical plate portion of the hinge stay is provided with a stay reinforcing bead that extends in the vehicle height direction and the stay reinforcing bead is not provided on a ridge of a connection portion between the vertical plate portion and the horizontal plate portion;

the stay reinforcing bead is curved at above a middle point of the stay reinforcing bead in the vehicle height direction such that an upper end of the stay reinforcing bead is located rearward of the vehicle than a lower end of the stay reinforcing bead; and the connection portion extends in the vehicle front-rear direction between the vertical plate portion and the horizontal plate portion, the hinge stay configured to deform at the connection portion at a time of collision such that the vertical plate portion tilts in the vehicle width direction.

* * * * *